United States Patent [19]

Martin

[11] 4,054,338

[45] Oct. 18, 1977

[54] ROTATABLE CABINET WITH SLIDABLE TOP

[76] Inventor: Michael G. Martin, 597-1 Auten Road, Somerville, N.J. 08876

[21] Appl. No.: 688,972

[22] Filed: May 24, 1976

[51] Int. Cl.[2] ..... A47B 87/00

[52] U.S. Cl. ..... 312/250; 312/282; 312/286; 312/223; 312/202

[58] Field of Search ..... 312/250, 286, 216, 186, 312/209, 202, 223, 282; 108/140, 143

[56] References Cited

U.S. PATENT DOCUMENTS

| | | | |
|---|---|---|---|
| 436,303 | 9/1890 | Crandall | 312/202 |
| 1,249,706 | 12/1917 | Zimmerman | 312/250 |
| 1,416,566 | 5/1922 | McCleary | 312/223 |
| 1,448,253 | 3/1923 | Bodker | 312/202 |
| 1,911,826 | 5/1933 | Kaelber | 312/223 |
| 2,171,772 | 9/1939 | Viehmann | 312/286 |
| 2,362,243 | 11/1944 | Chason et al. | 312/282 |
| 2,514,133 | 7/1950 | Barre et al. | 312/282 |
| 2,565,784 | 8/1951 | Sheean | 312/286 |
| 2,780,509 | 2/1957 | Gleitsman | 312/201 |
| 2,855,257 | 10/1958 | Barker et al. | 312/223 |

*Primary Examiner*—Paul R. Gilliam
*Assistant Examiner*—Victor N. Sakran
*Attorney, Agent, or Firm*—David S. Woronoff

[57] ABSTRACT

A cabinet having at least two sections, one rotatable with respect to the other, and an upper section having a top slidable in two directions.

10 Claims, 1 Drawing Figure

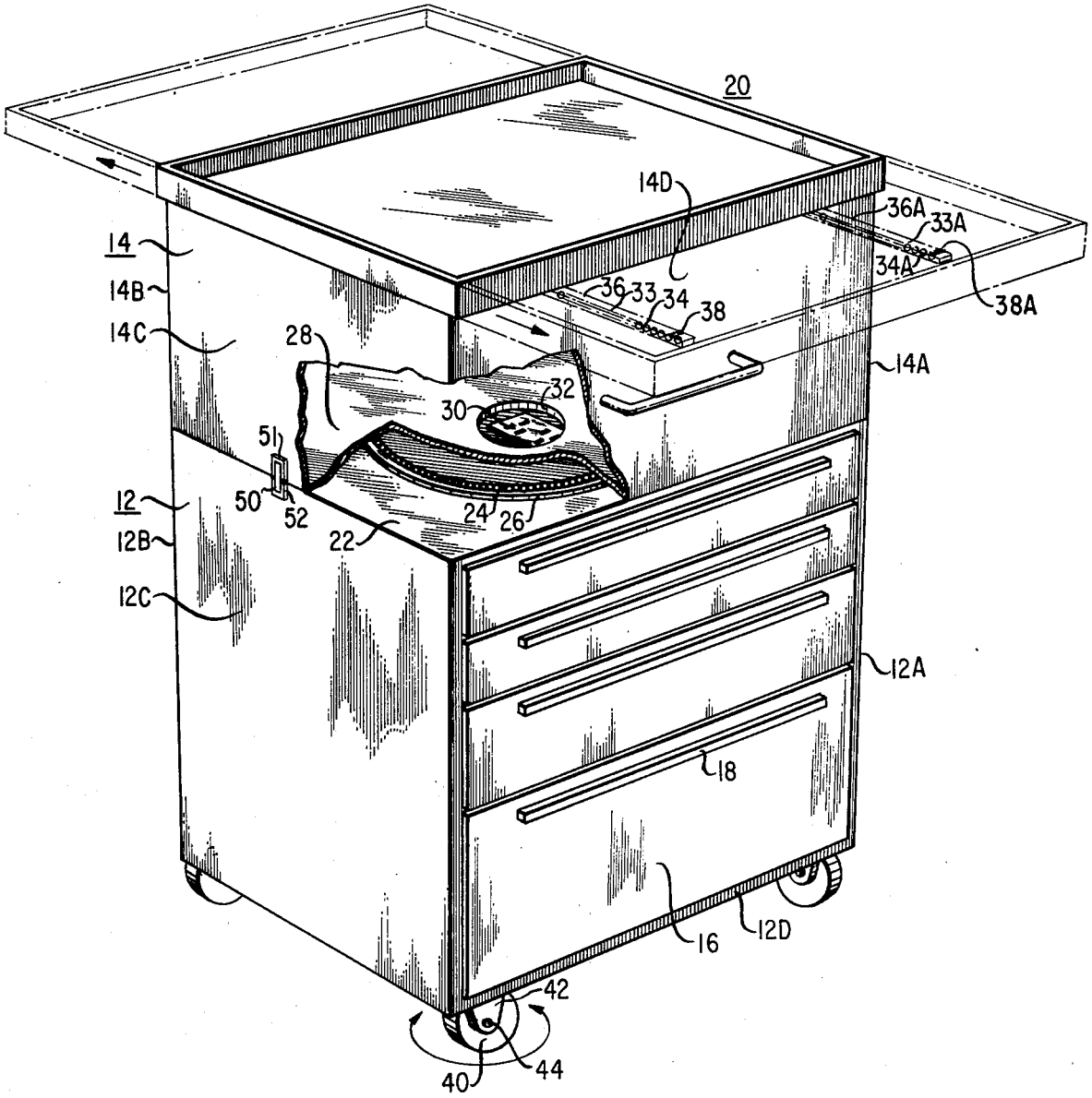
20
14D
36A
33A
34A
38A
14
14B
14C
36
33
34
38
28
14A
32
30
51
50
52
12
12B
12C
24
26
22
12A
18
16
12D
42
40
44

ROTATABLE CABINET WITH SLIDABLE TOP

BACKGROUND OF THE INVENTION

The present invention relates to a cabinet and more particularly to a cabinet having mutually rotatable storage sections.

Stationary and movable cabinets with a variety of sliding and swinging doors are well known.

Various specialists such as doctors, dentists, vetrenarians and other skilled professionals who must work around a fixed or relatively immovable object with a variety of tools and devices have need of a storage capacity which can be easily reached from a variety of positions and which can serve as a stable platform for sequentially utilizing the stored objects placed in the cabinet.

For such workers, ease of access to the contents of the cabinet regardless of the users relative orientation to the cabinet is highly desirable. In effect, such a user wants a cabinet which is always "in front" of him so that its contents are always readily available to him or his assistant without the need for either to change his position with respect to the person or object being worked on.

THE PRIOR ART

The most relevant patent literature in U.S. Pat. No. 2,780,509 issued to H. Gleitsman in 1957. This reference teaches a two section clothes hamper in which the top can open in the normal direction (i.e. vertically) or which can pivot in a horizontal direction from a hinge 92 shown in FIG. 4 of that patent. Hinge 92 is fixed on one side of the hamper so that access to the compartments of the hamper are very dependent on the users orientation with respect to it.

SUMMARY OF THE INVENTION

The present invention teaches a two or more section cabinet in which the section are rotatable with respect to each other on bearings centrally mounted with respect to the sections.

Because of the rotation of the sections, any upper section can be positioned for easy access to a user whose orientation has changed with respect to the normal "front" of the cabinet.

The present invention teaches a cabinet with two or more sections rotatable with respect to each other in which the upper section is a "well" having a slidable top such that access to the contents of the "well" will not depend on the users normal orientation to the "front" of the cabinet. Further, because the top is slidable in two directions with respect to the rotatable "well", the top can be moved out of the users way and provide a movable work surface for the user.

The present invention also teaches a novel two section cabinet in which an electrical outlet is brought to the user through a first section. Access to the outlet is gained through an aperature in a rotatable second section of the novel cabinet.

DESCRIPTION OF THE DRAWING

The FIGURE shows an embodiment of the present invention in perspective with the upper section partially broken away and in section.

DESCRIPTION OF THE INVENTION

Turning to the FIGURE there is shown by the numeral 10 a cabinet having a first section 12 having slides

12A, 12B and 12C. A plurality of drawers 16 having pulls 18 may be fitted into the first section 12 in any suitable manner. The first section 12 has a top 22 into which is fixed a bearing race 26 with bearings 24 disposed therein. The first section 12 encloses a volume.

A second section 14 has sides 14A, 14B, 14C, 14D which enclose a volume. The bottom 28 of the second section 14 rides on a bearing 24 so that the first section 12 is rotatable with respect to the second section 14.

An electrical outlet 30 is located in the top 22 of the first section.

The bottom 28 of the second section has a central aperature 32 which enables electrical devices (not shown) to be contained in the second section 14 to be electrified from power delivered to the first section 12.

An outlet for electricity could be mounted in the second section 14 to rotate with it if it were fitted with commutator-like segments to connect it to the first sections.

The second section top 20 has bearing races 33, 33A fitted to the top 20 and the upper surface 36 of the sides 14A, 14C. Bearings 34 roll in the races 33, 33A to enable the top 20 to move easily on the sides 14A, 14C. Stops 38 are placed in the races 33, 33A near either end to prevent the top 20 from being pulled away from second section 14.

A locking device 50 having mutually engaging parts 51, 52 is fastened respectively to the second and first sections 14, 12 and when parts 51, 52 are mutually engaged prevent the rotation of the sections relative to each other.

Legs 42 have axles 44 for mounting wheels 40 in the conventional manner.

The present invention shows a two section cabinet, but three or more mutually rotatable sections could be employed.

Similarly, the second section is shown as a "well" but it could be a section with all drawers or a combination of drawers and "well".

I claim:

1. In a cabinet
a first section,
a second section;
bearing means fixed to said first section,
said second section supported above said first section on said bearing means whereby said second section is rotatable with respect to said first section,
said first and second section are volume enclosing members,
said second section has a base member with a center aperature formed therein;
said first section has a top member with a central aperature formed therein;
said second section central aperature and said first section central aperature are mutually aligned on a common axis for allowing access from said second section to said first section.
said first section and said second section are each adapted as containers.

2. The cabinet claimed in claim 1 where:
said bearing means is centrally located with respect to said first section,
said bearing means comprises a single bearing race having a circular symetry having a center;
said first section top member central aperature having a center such that a line joining the bearing race center and the central aperature center will be substantially perpendicular to said second section base member; and, said first section aperature located within said bearing race.

3. The cabinet claimed in claim 2 wherein;

said bearing means is centrally located with respect to said second section, said second section base member central aperature having a center on the substantially perpendicular line joining the first section central aperature center and the bearing race center.

4. The cabinet claimed in claim 3 wherein;

electrical outlet means is located within said bearing means.

5. The cabinet claimed in claim 4 wherein:

said second section has vertically extending side members;

said side members having sliding surfaces;

a top member is slidably disposed on said sliding surface such that it is free to move in two directions on said sliding surfaces, said top member has a rest position with respect to said second section such that when said top member is in said rest position said top member covers said second sections;

said top member freedom of movement in said two directions is from said rest position.

6. The cabinet claimed in claim 5 wherein:

said side member sliding surfaces have bearing means for supporting said top member.

7. The cabinet claimed in claim 6 wherein:

lock means hold said top member in a first fixed position; and, first and second stop means hold said top member in first and second extended positions.

8. The cabinet claimed in claim 7 wherein:

first engaging means are fixed on said first section;

second engaging means are fixed on said second section;

said first and said second engaging means interact.

9. The cabinet claimed in claim 1 wherein:

said first section has wheel means fixed therein for engaging a supporting surface.

10. The cabinet claimed in claim 9 wherein:

said top member has a peripheral upwarding extending lip member connected thereto for preventing any object placed on said top member from sliding off of said top member;

said first section has a plurality of drawer members slidably fitted therein;

said electrical outlet means has a first fixed section and a second rotatable section;

commutator segments electrically interconnect said first and said second sections such that electrically operated appliances contained on said top member or said second section will rotate with said second rotatable section of said electrical outlet.

* * * * *